United States Patent [19]

Fujii

[11] Patent Number: 4,800,004

[45] Date of Patent: Jan. 24, 1989

[54] CONDUCTOR ROLL PROFILE ADJUSTMENT

[75] Inventor: Kazuo Fujii, Chiba, Japan

[73] Assignee: Kawasaki Steel Corp., Hyogo, Japan

[21] Appl. No.: 181,326

[22] Filed: Apr. 13, 1988

[51] Int. Cl.[4] ..... C25D 7/06

[52] U.S. Cl. ..... 204/28

[58] Field of Search ..... 204/28

[56] References Cited

U.S. PATENT DOCUMENTS

| | | | |
|---|---|---|---|
| 2,446,548 | 8/1948 | Nachtman | 204/211 |
| 3,483,098 | 12/1969 | Kramer | 204/28 |
| 3,483,113 | 12/1969 | Carter | 204/206 |
| 3,634,223 | 1/1972 | Carter | 204/206 |
| 4,415,425 | 11/1983 | Schacht | 204/279 |

FOREIGN PATENT DOCUMENTS

| | | |
|---|---|---|
| 46-7162 | 2/1971 | Japan . |
| 54-34691 | 10/1979 | Japan . |
| 58-207391 | 12/1983 | Japan . |

*Primary Examiner*—T. M. Tufariello

*Attorney, Agent, or Firm*—Bierman and Muserlian

[57] ABSTRACT

A conductor roll for electroplating is provided on its circumferential outer surface with a conductor ring and a pair of rubber linings, with a step formed between the outer sufaces of the conductor ring and the rubber lining. The profile of the roll is adjusted by cooling the conductor roll with coolant passing through the interior of the roll, and controlling the temperature of coolant in response to the information indicative of the step to thereby control the step to a predetermined value.

4 Claims, 2 Drawing Sheets

CONDUCTOR ROLL PROFILE ADJUSTMENT

BACKGROUND OF THE INVENTION

1. Field of the Invention

This invention relates to a method for adjusting the profile of a conductor roll. More particularly, it relates to a method for adjusting the profile of the outer surface of a conductor roll used in a radial plating apparatus for electroplating zinc or another metal onto one surface of a steel strip.

2. Discussion of the Prior Art

A typical radial plating apparatus is disclosed in U.S. Pat. Nos. 3,483,113 and 3,634,223. Apparatus of the type disclosed in these patents is schematically shown in FIG. 2. The apparatus includes a tank 1 containing electrolyte or plating solution 2, a conductor roll 3 partially immersed in the plating solution 2, and upstream and downstream deflector rolls 4, 4 disposed above opposed sides of the tank. A steel strip 5 is passed around upstream roll 4, conductor roll 3 and downstream roll 4 so that the strip 5 moves through the plating solution. The apparatus further includes a soluble anode 7 held by a main anode 6, both immersed in the solution, and optionally a roll polisher 8 in contact with the conductor roll 3 for removing a foreign matter. During movement of the strip 5 along the conductor roll 3, conduction of electricity causes plating metal to be dissolved out from the soluble anode 7 to deposit on the outside surface of the strip 5. In the case of an insoluble anode, metal ions in the solution are deposited.

The structure of the conductor roll 3 is shown in FIG. 3. The roll 3 includes a hollow metal cylinder 10, a conductor ring 11 at an intermediate of the outer circumference of the cylinder 10, and rubber linings 12 disposed on the cylinder 10 at the opposite sides of the ring 11. The interior of the roll 3 is cooled with coolant in the form of cooling water for absorbing the Joule heat created by plating current as shown by an arrow 13 indicating the flow of coolant.

As the strip 5 moves with the conductor roll 3 of this structure, the rubber linings 12 seal the opposite edges of the strip to prevent plating on the inside surface thereof. The rubber linings 12 are thus required to be corrosion resistant against the plating solution 2, fully stretchable to achieve a sealing function, and hard enough to be wear resistant.

However, it is difficult to obtain a material which meet all these requirements. Generally, a rigid rubber with Hs of about 90 having corrosion and wear resistance is used. Since this rubber allows only a relatively small amount of contraction and sretch, the surface level of the rubber lining 12 must be the same as or lower than that of the conductor ring 11 in order to maintain an intimate contact between the conductor ring 11 and the strip 5. Usually the surface level of the rubber lining 12 is lower than that of the conductor ring 11, as viewed in a radial direction, to form a step S therebetween as shown in FIG. 3. The components are usually designed and polished such that the distance of the step S falls in the range of from 0.1 to 0.3 mm.

The conductor ring 11 and the rubber lining 12 wear away due to contact with the strip 5 during operation. Since the rubber lining is more worn than the metal ring, the surface profile of the conductor roll 3, that is, the step S between the surfaces of the conductor ring 11 and the rubber lining 12 changes during operation. The conductor ring 11 can be more worn out when the roll polisher 8 is located in contact with the conductor ring 11.

The roll profile or the step S between the surfaces of the conductor ring 11 and the rubber lining 12 largely affects the quality of plating on the strip 5. If the step S becomes as large as 0.5 mm or more, the strip 5 is bent at the site of the step S as shown at A in FIG. 4*a*. If the conductor ring 11 is more worn than the rubber lining 12 to give a negative step as shown at B in FIG. 4*b*, the strip 5 cannot be held in full contact with the conductor ring 11, causing plating irregularities. It is thus very important to maintain a proper roll profile. In the prior art, the roll must be resurfaced once a year in order to maintain the step S in the range of from 0 to 0.5 mm. Replacement of the roll lowers productivity and the polishing operation is expensive.

SUMMARY OF THE INVENTION

A primary object of the present invention is to provide a method for adjusting the profile of a conductor roll whereby the step between the surfaces of a conductor ring and a rubber lining can be controlled within a predetermined range without resorting to frequent roll resurfacing.

Paying attention to the difference in thermal expansion between a conductor ring and a rubber lining, we have found that the step S between the surfaces of conductor ring and rubber lining can be maintained within a predetermined range by controlling the temperature of cooling water which is passed through the conductor roll for cooling.

According to the present invention, there is provided a method for adjusting the profile of a conductor roll for electroplating, the conductor roll having an axis and a circumferential outer surface and being provided on the circumferential outer surface with a conductor ring at an intermediate and a pair of rubber linings at axially opposed sides of the conductor ring, a step being formed between the outer surfaces of the conductor ring and the rubber lining, the method comprising passing coolant through the interior of the conductor roll to cool the roll, and controlling the temperature of the coolant in response to the information indicative of the step to thereby control the step to a predetermined value.

Preferably, the predetermined value is in the range of from 0 to 0.5 mm.

Preferably, the method further comprises measuring the step by gauge means to produce the information indicative of the step. Alternatively, the information indicative of the step may be derived from presumed depths of wear of the conductor ring and the rubber lining.

BRIEF DESCRIPTION OF THE DRAWINGS

These and other objects, features, and advantages of the present invention will be better understood from the following description taken in conjunction with the accompanying drawings, in which.

DESCRIPTION OF THE PREFERRED EMBODIMENT

Figure 1:
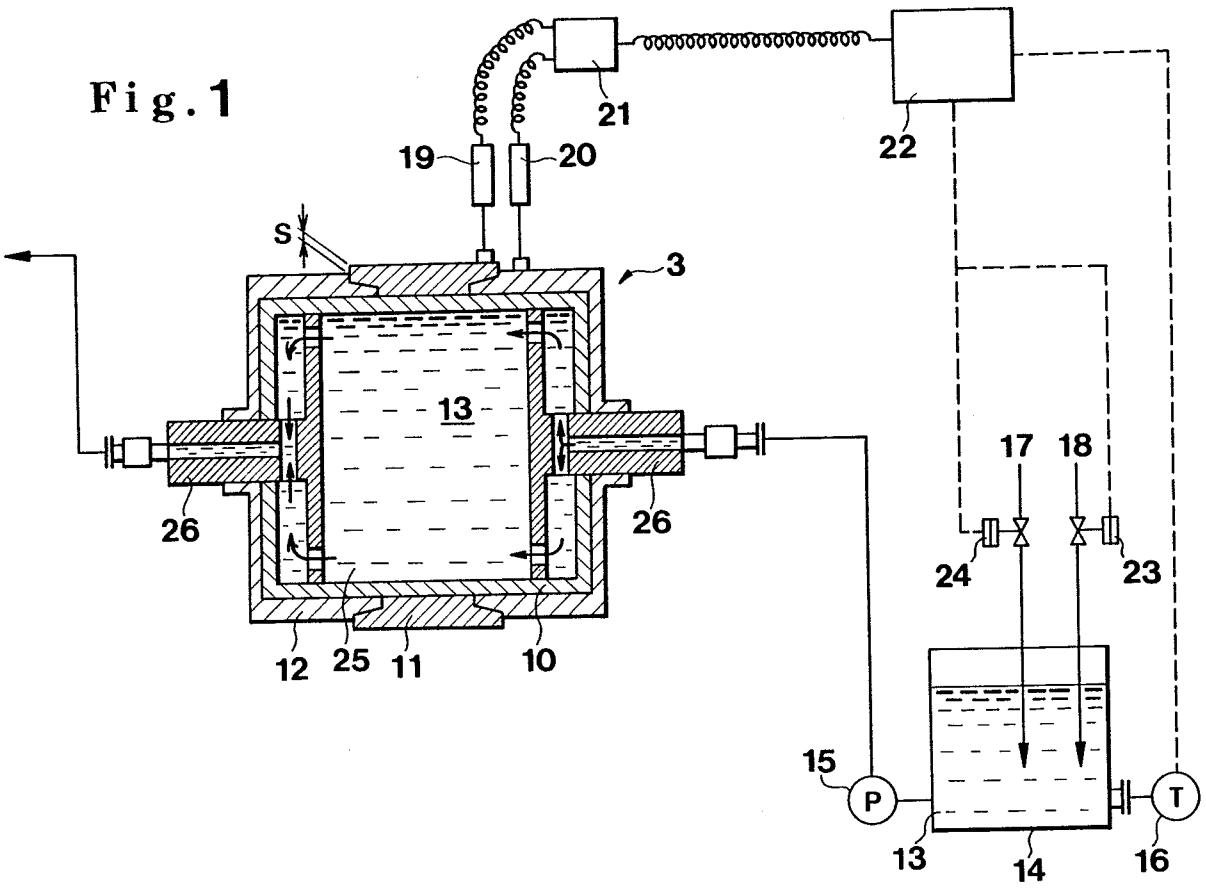
FIG. 1 is a schematic view showing one apparatus with which the method of the present invention is carried out.
Figure 2:
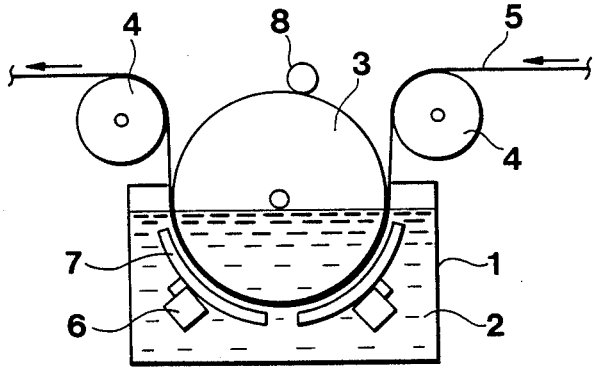
FIG. 2 is a schematic illustration of a typical radial plating apparatus.
Figure 3:
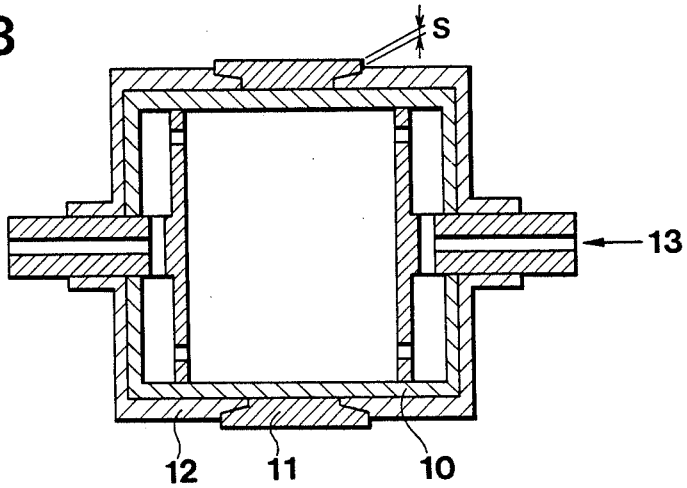
FIG. 3 is an axial cross section of the conductor roll in the apparatus of FIG. 2.
Figure 4A:
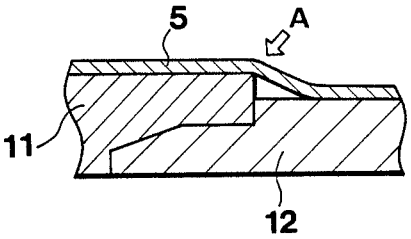
FIGS. 4*a* and 4*b* illustrate defects occurring in a steel strip due to an undesired profile of the conductor roll.
Figure 4B:
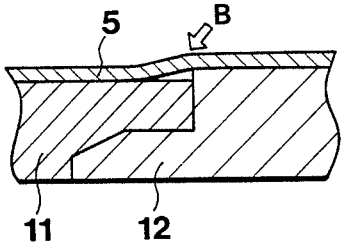

Referring to FIG. 1, there is illustrated a conductor roll to which the method of the present invention is applicable. The conductor roll illustrated herein is used in a radial electroplating apparatus as shown in FIG. 2.

The roll 3 includes a hollow metal cylinder 10 having a central shaft 26 and a circumferential outer surface and defining an interior 25. The cylinder 10 is provided with a conductor ring 11 at an intermediate of the circumferential outer surface, and a pair of rubber linings 12 disposed on the circumferential outer surface at opposed sides of the ring 11. The cylinder 10 is cooled by passing coolant therethrough to absorb the Joule heat created by plating current. More particularly, the coolant in the form of cooling water 13 is pumped from a tank 14 to the interior 25 of the cylinder 10 through a bore in the right half of the shaft 26 and then discharged through a bore in the left half of central shaft 26.

The method of the present invention is characterized by controlling the temperature of cooling medium, for example, cooling water 13.

Steam 17 is fed from a tank (not shown) to the cooling water tank 14 through a feed line with a control valve 24 which is opened and closed by means of a computing unit 22. Make-up water 18 is also fed from a tank (not shown) to the cooling water tank 14 through a feed line with a control valve 23 which is opened and closed by means of the computing unit 22. Cooling water 13 in the tank 14 is fed to the bore in the center shaft 26 of the conductor roll 3 by a pump 15.

A thermometer 16 is mechanically disposed at a proper position in the tank 14 and electrically connected to the computing unit 22. The thermometer 16 functions to measure the temperature T of cooling water 13 and transmit the measured temperature in the form of an electrical signal to the computing unit 22.

A touch roll gauge 19 is disposed in contact with the conductor ring 11 on the outer surface of the conductor roll outside the zone where a steel strip 5 is wrapped around the outside surface of the ring 11. Another touch roll gauge 20 is disposed in contact with the rubber lining 12 at a similar site out of contact with the strip 5. The touch roll gauges 19 and 20 function to measure the depths of wear on the surface of the conductor ring 11 and the rubber lining 12, respectively. These gauges are electrically connected to the computing unit 22 through a detector or comparator 21.

The depths of wear of the conductor ring 11 and the rubber lining 12 of the conductor roll 3 are measured by the touch roll gauges 19 and 20. Upon receipt of the measured depths of wear, the detector 21 produces an output indicative of the step S between the surfaces of the conductor ring 11 and the rubber lining 12 to the computing unit 22. The computing unit 22 compares the actual step S with the preset step S0 to compute the difference (S0−S) therebetween.

When (S0−S)>0, the computing unit 22 delivers a signal to the control valve 23 to open the valve to feed make-up water so as to lower the temperature T of cooling water 13. When (S0−S)<0, the computing unit 22 delivers another signal to the control valve 24 to open the valve to feed steam so as to raise the temperature T of cooling water 13. In either case, the temperature T of cooling water 13 is automatically controlled so that the difference (S0−S) be equal to zero, that is, the preset step S0 be maintained.

By utilizing the difference h in thermal expansion between the materials of the conductor ring 11 and the rubber lining 12, the method of the present invention controls the temperature T of cooling water to control the temperature T1 of the conductor roll. The difference between the depths of wear of the conductor ring 11 and the rubber lining 12 is then compensated for by thermal expansion, thereby controlling the step S between the conductor ring 11 and the rubber lining 12 so as to be equal to the preset value S0.

The conductor ring 11 is formed of alloy steel such as stainless steel and Hastelloy because of corrosion and wear resistance. For example, a Hastelloy has a coefficient of linear expansion of $0.117\times10^{-4}$1/°C. On the other hand, the lining 12 is formed of synthetic rubber because of corrosion and wear resistance. For example, a urethane rubber has a coefficient of linear expansion of $0.171\times10^{-3}$1/°C. If the conductor roll 3 has a radius of 1,220 mm and the temperature of the roll is raised 1° C., the difference in linear expansion is $h=(0.171\times10^{-3}0.117\times10^{-4})\times1{,}220=0.194$ mm/°C. However, an actual difference does not coincide with such a mathematical calculation because the metal cylinder 10 undergoes a less thermal expansion and expansion of the rubber lining 12 is suppressed thereby.

It is thus necessary to carry out a roll temperature rising test to obtain actual measurements. In an experiment in which the conductor ring 11 of Hastelloy and the rubber lining 12 of urethane rubber both had a thickness of 20 mm and the metal cylinder 10 was made of SS 41 having a coefficient of linear expansion of $0.114\times10^{-4}$1/°C., the actual difference in thermal expansion between the ring 11 and the lining 12 was measured to be $\Delta h=0.010$ mm/°C., indicating that the urethane rubber expanded more than the Hastelloy.

Next, the relation of the roll temperature T1 to the cooling water temperature T is described.

The temperature T1 of the roll depends on two factors, the temperature T of cooling water and the temperature T2 of plating solution 2. For example, the average temperature $T1=(T+60)/2$ when $T2=60°$ C.

This means that when a rise of 1° C. in cooling water temperature T leads to a rise of 0.5° C. in roll temperature T1. Thus 50% of the cooling water temperature rise contributes to a thermal expansion difference. The thermal expansion difference Δh between the ring and the lining is related to a change of cooling water temperature ΔT such that $$\Delta h=5.0\times10^{-3}\Delta T$$

for the above-described conductor roll having a radius of 1,220 mm and the Hastelloy and urethane rubber both having a thickness of 20 mm.

Theoretically, when it is desired to set the step S of a greater value, the step S can be minimized by raising the roll temperature T1 and the corresponding cooling water temperature T because urethane expands more than Hastelloy. However, the heat resistant temperature of the lining rubber imposes an upper limit on the roll temperature T1. Since urethane rubber experiences a substantial thermal deterioration at temperatures in excess of 70° C., the cooling water should preferably be used at a temperature of not higher than 70° C. ($T\leqq70°$ C.).

Although the touch roll gauges 19 and 20 are used in the apparatus shown in FIG. 1 to measure the depths of wear to obtain the information indicative of the step, any other means of non-contact type such as by using microwave may be used to measure the depths of wear.

The information indicative of the step need not be a measurement. If the depth of wear of the conductor roll 3 is known as a function of the amount (in ton) of steel strip passed thereacross from the past operation data or experimental data, the equation representing the relation of the step to the amount of steel strip passed is input in the computing unit 22. Then the temperature of cooling water may be computed so as to attain the predetermined profile. In this case, means for measuring the depth of wear such as the touch roll gauges 19 and 20 are unnecessary.

Although the preferred embodiment of the invention is described, the present invention is not limited to the illustrated apparatus. The method of the present invention is applicable to any conductor roll of a radial electroplating apparatus.

EXAMPLES

Examples of the present invention are presented below by way of illustration and not by way of limitation.

In the apparatus shown in FIG. 1, the conductor roll 3 had a radius of 1,220 mm and included the conductor ring 11 of Hastelloy and the linings 12 of urethane rubber. Profile adjustment was carried out provided that the preset step S0 should be controlled within the range of from 0.1 to 0.3 mm and cooling water was used at a temperature in the range of from 30° C. to 70° C. The conductor roll 3 was polished such that the step S was equal to 0.10 mm when the roll was cooled with cooling water at 30° C.

EXAMPLE 1

An experiment was carried out using the touch roll gauges 19 and 20.

First, an experiment was carried out by inputting a preset step S0 of 0.1 mm in the computing unit 22. Since the urethane rubber wore out to increase the step with a lapse of time of operation, the temperature of cooling water was gradually raised and eventually reached 70° C. after one year.

Since the urethane rubber was less resistant to higher temperatures, the temperature of cooling water was lowered to 30° C. to find that the step was 0.3 mm. The depth of wear of urethane rubber was 0.2 mm. It was determined that this depth of wear could be compensated for by raising the temperature of cooling water by 40° C. It was confirmed that the above-mentioned equation:

$$\Delta h = 5.0 \times 10^{-3} \Delta T$$

was correct.

Next, profile adjustment was again carried out by inputting a preset step S0 of 0.3 mm in the computing unit 22 and controlling the temperature of cooling water. The temperature of cooling water reached 70° C. after one year of operation. At this point, the roll was removed for resurfacing.

Profile adjustment according to the present invention enabled continuous operation for two years. This is in contrast to the prior art technique in which the step exceeded 0.3 mm in about one year and the roll should be resurfaced.

EXAMPLE 2

Profile control is carried out on the base of the amount (in ton) of steel strip passed. It is known from the past experience that the urethane rubber is more worn out by 0.2 mm than the ring when 200,000 tons of steel strip has been passed. The temperature of cooling water is controlled in accordance with the amount (in ton) of steel strip passed. In the same apparatus as used in Example 1, similar results could be obtained by inputting the following equations:

$$0.2 \times W/20 = 5.0 \times 10^{-3} \Delta T \text{ and}$$

$$\Delta T = 2W$$

wherein W is the amount (in $10^4$ tons) of steel strip passed, in the computing unit 22 and controlling the temperature of cooling water.

According to the present invention, the temperature of coolant with which the conductor roll is cooled is controlled to maintain the profile of the roll substantially constant, greatly extending the interval of mechanically resurfacing the roll.

I claim:

1. A method for adjusting the profile of a conductor roll for electroplating, the conductor roll having an axis and a circumferential outer surface and being provided on the circumferential outer surface with a conductor ring at an intermediate and a pair of rubber linings at axially opposed sides of the conductor ring, a step being formed between the outer surfaces of the conductor ring and the rubber lining, the method comprising cooling the conductor roll with a coolant passing through the interior of the roll, and controlling the temperature of the coolant in response to the information indicative of the step to thereby control the step to a predetermined value.

2. The method of claim 1 wherein the predetermined value is in the range of from 0 to 0.5 mm.

3. The method of claim 1 which further comprises measuring the step by gauge means to produce the information indicative of the step.

4. The method of claim 1 wherein the information indicative of the step is derived from presumed depths of wear of the conductor ring and the rubber lining.

* * * * *